US006501037B2

(12) United States Patent
Gressier et al.

(10) Patent No.: US 6,501,037 B2
(45) **Date of Patent: *Dec. 31, 2002**

(54) PUSH-BUTTON SWITCH FOR EMERGENCY SHUT-DOWN

(75) Inventors: Alain Gressier, Puymoyen (FR); Michel Gendre, L'Isle d'Espagnac (FR)

(73) Assignee: Schneider Electric Industries SA, Ruel-Malmaison (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/550,335

(22) Filed: Apr. 14, 2000

(65) Prior Publication Data

US 2002/0134656 A1 Sep. 26, 2002

(30) Foreign Application Priority Data

Apr. 16, 1999 (FR) ..... 99 05069

(51) Int. Cl.[7] ..... H01H 3/12
(52) U.S. Cl. ..... 200/341; 200/43.07
(58) Field of Search ..... 200/43.08, 43.11, 200/43.13, 43.16, 43.18, 50.09, 318.1, 318.2, 566, 341; 70/360, DIG. 30

(56) References Cited

U.S. PATENT DOCUMENTS 4,697,052 A 9/1987 Ruaud ..... 200/43.07
4,903,512 A * 2/1990 Leroy et al. ..... 70/379 R

FOREIGN PATENT DOCUMENTS

| | | |
|---|---|---|
| DE | 36 08 569 | 9/1987 |
| EP | 0 172 926 | 3/1986 |
| FR | 2 521 768 | 8/1983 |
| GB | 2 169 142 | 7/1986 |

* cited by examiner

*Primary Examiner*—Elvin Enad
*Assistant Examiner*—Lisa N. Klaus
(74) *Attorney, Agent, or Firm*—Oblon, Spivak, McClelland, Maier & Neustadt, P.C.

(57) ABSTRACT

This invention relates to a push-button type switch comprising electrical contacts actuated by a head made up of a command button (1) associated with a body (2) within which is housed a piston (4) and a push rod (6) acting on electrical contacts which are able to slide and to pivot within the body (2) along an axis (X—X) without being able to pivot relative to one another, the push rod (6) being fitted with a first catch (7) and a second catch (8) characterized by the fact that the piston (4) is fitted with a command device (41) capable, when the button (1) is pushed, of actuating the first catch (7) called the stop catch immobilizing the push rod (6) in the "stand-by" position and then releasing the push rod (6) which can move into the "held" position where it is immobilized by the second catch (8) which is used to maintain contact.

11 Claims, 2 Drawing Sheets

PUSH-BUTTON SWITCH FOR EMERGENCY SHUT-DOWN

BACKGROUND OF THE INVENTION

1. Field of the Invention

This invention relates to an electrical switch of the maintained contact push button type, intended for emergency shut-downs and comprising a body and a command button mounted on a cylindrical body and acted upon by a return spring.

2. Discussion of the Background

A switch of the maintained contact push button type permits actuation of the electrical contacts when an operator presses the push button at the moment of an emergency shut-down. The actuating push button is mounted on a body within which a movable piston and a movable push rod are housed, the latter being used to actuate the electrical contacts. This piston and this push rod are capable of sliding and pivoting within the body, along an axis, while at the same time being immobilized relative to one another. The piston is held in the "on" position by a catch. When an operator presses the actuating push button, the piston is moved by a cocking spring to a trip or stop position, a position in which it is held by the same catch, after having actuated the electrical contacts.

After the trip, following an emergency shut-down, the push button remains driven in, in the trip or stop position. It can be unlocked in such a way that it returns to the "on" position, using a key inserted into a barrel or by rotation of the head.

The size of the interlock is variable mainly due to piling up of the sides and of the coefficient of friction which has a negative effect on safety.

SUMMARY OF THE INVENTION

The purpose of the invention is to provide a maintained contact push button with improved safety.

The switch according to the invention is essentially characterized by the fact that the piston is fitted with a command device capable, when the button is pushed, of actuating the first catch, called the stop catch, immobilizing the push rod in the "stand-by" position and then releasing the push rod which can move into the "contact" position where it is immobilized by the second catch which is used to maintain contact.

According to one characteristic, the command push rod has guiding means which are guided onto helical ramps created in the body.

According to another characteristic, the body has a ramp used for the backward movement of the catch when the push rod pivots about its axis of rotation and a boss permitting the indexing of the push rod and of the piston in the contact position.

BRIEF DESCRIPTION OF THE DRAWINGS

The invention will now be described in more detail, referring to embodiments given by way of non-limitative limitative examples which make reference to the appended drawings in which.

DETAILED DESCRIPTION OF THE PREFERRED EMBODIMENTS

Figure 1:
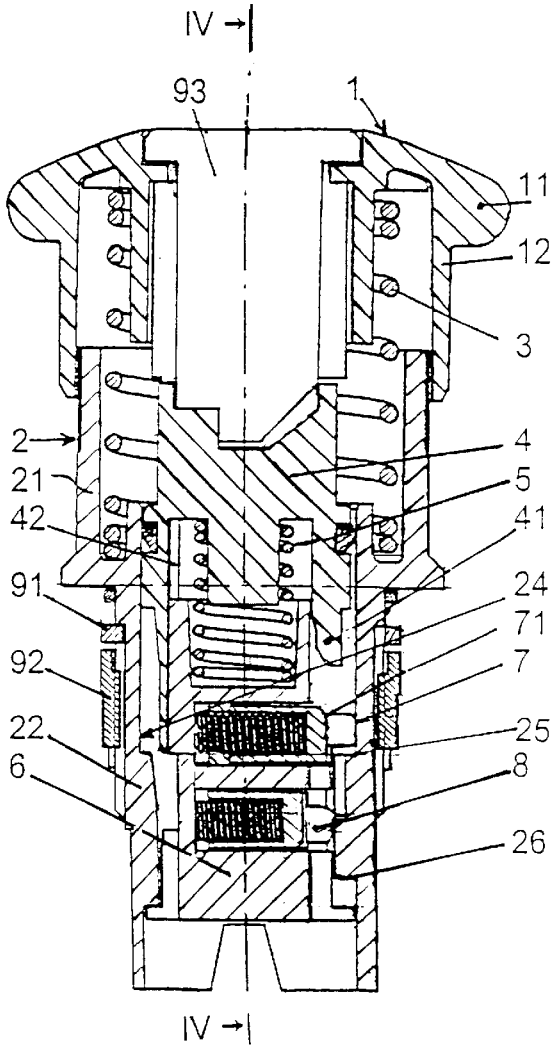
FIG. 1 is an axial section of the head of the push button according to the invention shown in the "stand-by" position.
Figure 2:
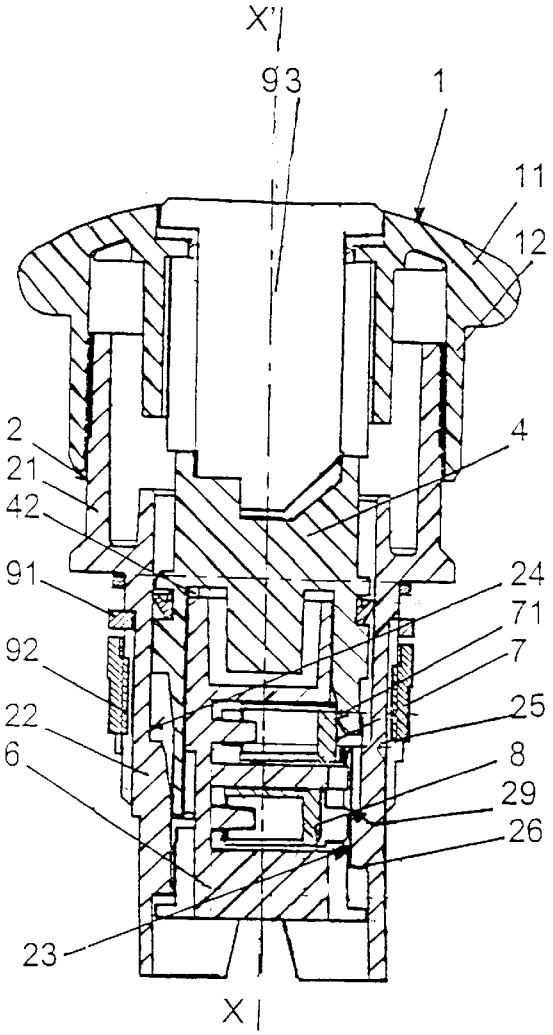
FIG. 2 is an axial section of the head of the push button of FIG. 1 shown during the course of a trip following an emergency shut down.
Figure 3:
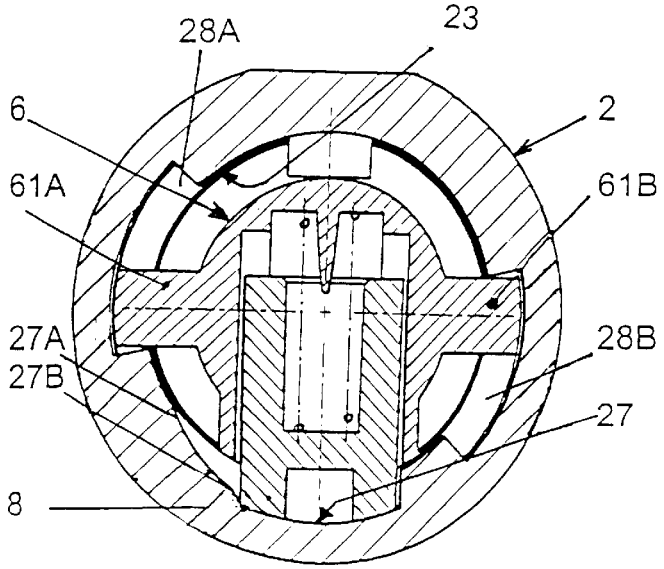
FIG. 3 is a cross section of the head of FIGS. 1 and 2.
Figure 4:
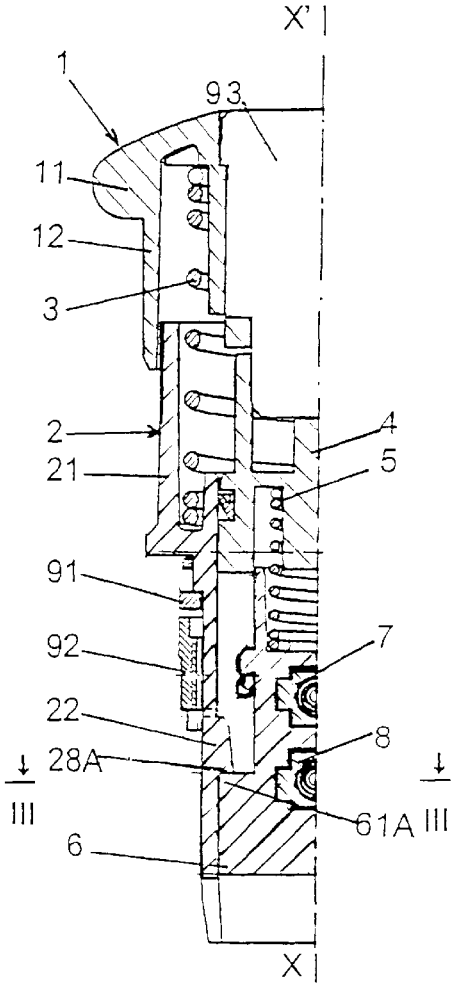
FIG. 4 is a half section along IV—IV in FIG. 1.
Figure 5:
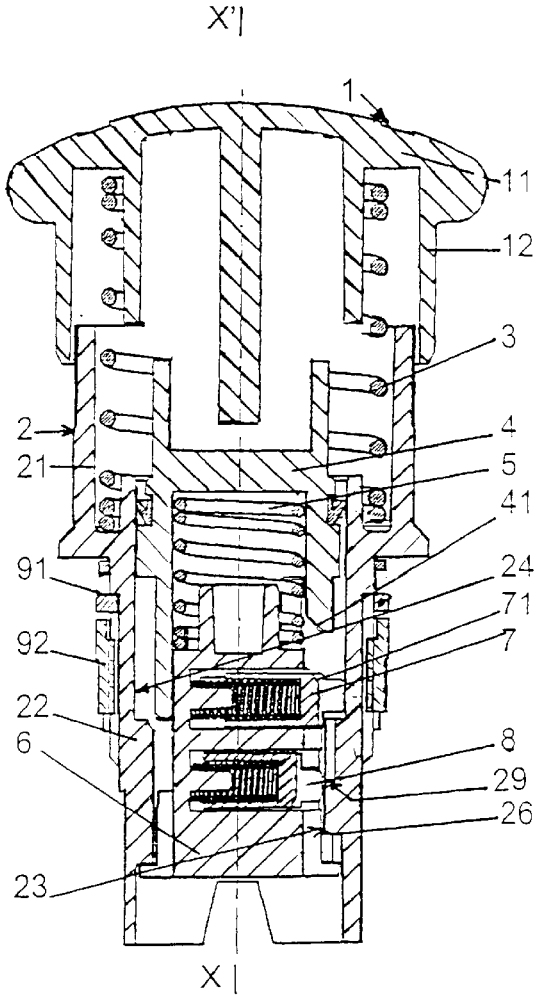
FIG. 5 is an axial section of a variant without a lock for the head illustrated in FIG. 1.

The head of the push button which is illustrated in FIGS. 1 to 5 is associated with electrical contact blocks which are not shown. It comprises, at the front, a manually operated push button 1 which the operator can press at the moment of triggering an emergency shut down. This push button 1 is mounted in a sliding manner on a body 2 within which the various constituent parts are housed and which is used for fixing the assembly to a fixing panel which is not shown.

The body 2, which has a tubular shape and is cylindrical about an axis X–X', is made up of a front part 21 and a rear part 22, the latter being of smaller diameter and separated from the front part by a shoulder. The body 2 is engaged by means of its rear part 22 in an opening in a mounting panel, to which it can be fixed in a sealed fashion by an external seal, by an anti-rotation plate 91 and by a fixing nut 92.

The manually operated push button 1 has a cylindrical mushroom shape, the top part 11 being used as the button and the lower part 12, in the form of a skirt, covering the body 2. The immobilization means made in the body 2 and in the button 1 prevents their relative rotation. These means can be constituted by internal flutes made in the skirt which slide in external flutes in the body or by a sliding keyway. Furthermore, the button 1 is stopped in the upper position, with respect to the body 2, by tenons 61A, 61B which come into abutment, upwards against helical ramps 28A, 28B made in the body 2.

A helical spring 3 is mounted in such a way that it is compressed between the body 2 and the button 1 and transmits a return force to the button 1. One of its ends is housed in an annular housing in the body 2, while the other end is housed in an annular housing in the button 1.

In an axial housing, the push button 1 receives a lock barrel 93 which can turn and which can be actuated by a key which is not shown. The barrel 93 can turn in its housing when the key is present.

The barrel 93 is connected in rotation and in translation to a piston 4 which is housed and guided in such a way that it slides and pivots along the axis X–X' in a bore 24 in the body 2. A seal is mounted around the piston 4 in a way that provides a seal with the body.

The piston 4 co-operates with an internal command push rod 6 used to actuate the electrical contacts. This push rod 6 is also housed and guided in translation along the axis X–X' in a bore 23 in the body 2 while remaining free to pivot about this axis. The piston 4 and the internal push rod 6 can slide with respect to one another but they have means 42 connecting them in rotation about the axis X–X'. These means can be constituted by a keyway or by conjugate flutes and grooves made respectively on the piston and on the push rod.

A helical cocking spring 5 is mounted in such a way that it is compressed between the piston 4 and the internal command push rod 6. Its ends are housed on the one hand in a housing in the piston 4 and on the other hand in a housing in the internal push rod 6.

The internal push rod 6 bears a first sliding catch 7 used as a stop in the "on" position and a second catch 8 used to hold it in the "off" position after tripping. The holding catch 8 can slide along an axis perpendicular to X–X' and is acted upon by a return spring which tends to push it away from the push rod. The catch 7 can slide along an axis perpendicular to X–X' and is also acted upon by a return spring tending to push it away from the push rod.

In the stand-by position, the stop catch 7 is able to abut against the shoulder 25 in such a way that the push rod 6 is immobilized (at the end of its forward stroke). This catch 7 is provided with a support ramp 71 which can co-operate with an unlocking finger 41 on the piston 4. When this unlocking finger 41 presses on the ramp 71, it drives the catch 7 into its housing, working against the action of the associated spring, which releases the push rod 6 from the "on" position.

In the "stand-by" position, the holding catch 8 remains held in compressing the associated spring. After driving in the stop catch 7 and releasing the push rod 6, the latter can move down under the action of the cocking spring 5. The head of the holding catch 8 slides in the bore 23 in the body 2. When it gets to the shoulder 26, the head of catch 8 comes out and presses against this shoulder 26 which has the effect of immobilizing the push rod 6 in the "hold and stop" position. Simultaneously, the push rod 6 acts on the electrical contact blocks.

The internal push rod 6 has, projecting from it, recocking tenons 61A and 61B which are guided upwards against helical recocking ramps 28A and 28B made in the body 2. Recocking is carried out, after tripping and shut down, by rotation of the piston 4/push rod 6 assembly which has the effect of pushing the push rod 6 back up as far as the "stand-by" position (end of forward stroke).

The push rod 6 is driven into the bore of the body 2 along the axis X–X' in response to a pressure exerted on its front part of the push button 1, working against the force of a return spring 3. During this emergency shut down phase, it is immobilized in rotation about X–X' and is moved from the stand-by position (end of forward stroke) to the held and tripped position (end of backward stroke).

The body 2 has, in its bore 27, a ramp 27A which is used to drive in the holding catch 8 when the operator pivots the push rod 6 about the axis X–X'. This unlocking of the catch 8 has the effect of releasing the push rod 6 from its "hold and stop" position and allows it to return to the "on" position. On the other hand, a boss 27B is made in front of the retracting ramp 27A in a way that enables the push rod 6 and the piston 4 to be indexed in the "stop and hold" position.

The head of the push button which has just been described above operates in the following way.

The initial "stand-by" position is illustrated in FIG. 1. In this position, the push button 1 is in abutment against a part of the body. The tenons 61A and 61B are in abutment upwards against the ramps 28A, 28B. The catch 7 is immobilized on the shoulder 25 and the push rod 6 is in the "high" position.

When an operator triggers the emergency shut down, he pushes manually on the push button 1 via the front part. The piston 4 goes down and with it, the unlocking finger 41. This finger, arriving on the head of catch 7 (FIG. 2) drives it into its housing. The catch 7 on being released from the abutment shoulder 25 releases the push rod 6 which is driven in under the effect of the spring 5. As soon as the head of the catch 8 clears the shoulder 26, this catch is brought out of its housing and immobilizes the push rod 6 in the "hold and stop" position. The push rod 6 simultaneously actuates the electrical contacts. The stroke is limited by the catch 7 pressing against the abutment 29 in such a way that the push rod 6 does not strike the electrical contacts.

To recock the apparatus, the user must engage the key and turn the barrel, the piston 4 and the push rod 6, in the direction r. This rotation causes the return of catch 8 into its housing, which releases the push rod 6 which can then go back up under the action of the return spring 3. The rise of the push rod 6 during the rotation is caused by the tenons 61A–61B and the conjugate ramps 28A–28B. This has the effect of compressing the spring 5 which maintains the space between the piston and the push rod. As soon as the head of the stop catch 7 clears the shoulder 25, this catch 7 is brought out of its housing and immobilizes the push rod 6 in the "stand-by" position (FIG. 1) The rotation of the push rod 6 and of the piston 4 is restricted by the tenons 61A and 61B which come into abutment upwards against the ramps 28A and 28B.

It is understood that, without departing from the scope of the invention, variants and improvements in detail can be conceived and similarly the use of equivalent means can be envisaged.

What is claimed is:

1. A push button switch comprising electrical contacts actuated by a head constituted by a command button associated with a body within which are housed a piston and a push rod for moving electrical contacts which are capable of sliding and pivoting within the body along an axis without being able to pivot relative to one another, the push rod being fitted with a first catch and a second catch, wherein the first catch is positioned at a fixed distance along the axis from the second catch, wherein the piston is fitted with a command device capable, when the command button is pushed, of actuating the first catch, immobilizing the push rod in a stand-by position and of then releasing the push rod which can come into a held position where the push rod is immobilized by the second catch.

2. The switch according to claim 1, wherein the push rod has guide means which are guided onto helical ramps made in the body.

3. The switch according to claim 1, wherein the second catch is driven into the stand-by position and, after release of the push rod, immobilizes the push rod in the held position.

4. The switch according to claim 1, wherein the command button receives, in a housing, a locking barrel that turns with a key and is connected in rotation and in translation to the piston.

5. The switch according to claim 2, wherein the second catch is driven into the stand-by position and, after release of the push rod, immobilizes the push rod in the held position.

6. The switch according to claim 2, further comprising a cocking spring mounted in such a way that the cocking spring is compressed between the piston and the push rod.

7. The switch according to claim 6, wherein the second catch is driven into the stand-by position and, after release of the push rod, immobilizes the push rod in the held position.

8. A push button switch comprising electrical contacts actuated by a head constituted by a command button associated with a body within which are housed a piston and a push rod for moving electrical contacts which are capable of sliding and pivoting within the body along an axis without being able to pivot relative to one another, the push rod being fitted with a first catch and a second catch, wherein the piston is fitted with a command device capable, when the command button is pushed, of actuating the first catch, immobilizing the push rod in a stand-by position and of then releasing the push rod which can come into a held position where the push rod is immobilized by the second catch, wherein the body has a ramp used to move the catch back when the push rod pivots about the axis and a boss that permits indexing of the push rod and the piston in a trip position.

9. The switch according to claim 8, wherein the second catch is driven into the stand-by position and, after release of the push rod, immobilizes the push rod in the held position.

10. A push button switch comprising electrical contacts actuated by a head constituted by a command button associated with a body within which are housed a piston and a push rod for moving electrical contacts which are capable of sliding and pivoting within the body along an axis without being able to pivot relative to one another, the push rod being fitted with a first catch and a second catch, wherein the piston is fitted with a command device capable, when the command button is pushed, of actuating the first catch, immobilizing the push rod in a stand-by position and of then releasing the push rod which can come into a held position where the push rod is immobilized by the second catch, wherein the push rod has guide means which are guided onto helical ramps made in the body, and wherein the body has a ramp used to move the catch back when the push rod pivots about the axis and a boss that permits indexing of the push rod and the piston in a trip position.

11. The switch according to claim 10, wherein the holding catch is driven into the stand-by position and, after release of the push rod, immobilizes the push rod in the held position.

* * * * *

UNITED STATES PATENT AND TRADEMARK OFFICE

CERTIFICATE OF CORRECTION

PATENT NO. : 6,501,037 B2 
DATED : December 31, 2002
INVENTOR(S) : Gressier et al.

It is certified that error appears in the above-identified patent and that said Letters Patent is hereby corrected as shown below:

Title page,
Item [73], the Assignee's city of address is spelled incorrectly. Item [73] should read:
-- [73] Assignee: Schneider Electric Industries SA,
Rueil-Malmaison --

Signed and Sealed this

Seventeenth Day of June, 2003

JAMES E. ROGAN
*Director of the United States Patent and Trademark Office*